US006830420B2

(12) United States Patent
Westphal

(10) Patent No.: US 6,830,420 B2
(45) Date of Patent: Dec. 14, 2004

(54) JIG AND METHOD FOR MANUFACTURING A CONTAINER

(76) Inventor: Scott K. Westphal, 850 West Ave., Miami Beach, FL (US) 33139

( * ) Notice: Subject to any disclaimer, the term of this patent is extended or adjusted under 35 U.S.C. 154(b) by 244 days.

(21) Appl. No.: 10/028,777

(22) Filed: Dec. 28, 2001

(65) Prior Publication Data

US 2003/0121306 A1 Jul. 3, 2003

(51) Int. Cl.[7] ..... B21D 51/32
(52) U.S. Cl. ..... 413/37
(58) Field of Search ..... 413/37, 31, 32, 413/42; 72/715

(56) References Cited

U.S. PATENT DOCUMENTS

| | | | | |
|---|---|---|---|---|
| 1,428,992 A | * | 9/1922 | Smith | 413/37 |
| 3,556,031 A | | 1/1971 | Frankenberg | |
| 4,183,315 A | | 1/1980 | Rogers | |
| 4,808,053 A | | 2/1989 | Nagai et al. | |
| 5,027,580 A | | 7/1991 | Hymes et al. | |
| 5,839,869 A | | 11/1998 | Moran et al. | |
| 5,911,551 A | | 6/1999 | Moran | |
| 5,957,647 A | | 9/1999 | Hinton | |
| 6,065,634 A | | 5/2000 | Brifcani et al. | |
| 6,123,493 A | | 9/2000 | Politt | |
| 6,138,534 A | | 10/2000 | Cho | |
| 6,290,447 B1 | | 9/2001 | Siemonsen et al. | |

FOREIGN PATENT DOCUMENTS

| | | | | |
|---|---|---|---|---|
| JP | 62-244537 | | 10/1987 | |
| JP | 01249232 A | * | 10/1989 | B21D/51/30 |
| JP | 01249234 A | * | 10/1989 | B21D/51/30 |
| JP | 01254331 A | * | 10/1989 | B21D/51/30 |
| JP | 1-284443 | | 11/1989 | |
| JP | 1-289526 | | 11/1989 | |
| JP | 6-15389 | | 1/1994 | |

* cited by examiner

*Primary Examiner*—Lowell A. Larson

(57) ABSTRACT

A jig is provided that includes a support portion configured to receive and vertically support a container thereon. The support portion has at least one retaining portion that is configured to non-rotationally lock with a retaining element of the container to substantially prevent relative rotation between the jig and container. Additionally, a method is provided for forming a container. The method includes forming a container body having a retaining element and providing a jig to support the container body thereon and having a retaining portion configured to non-rotationally lock with the retaining element. Additionally, the method includes positioning the container body relative to the jig so as to effect the non-rotational lock between the retaining element and retaining portion and positioning a lid on the container body. Furthermore, the method includes forming a seam between a periphery of the lid and the open end portion of the container body.

25 Claims, 11 Drawing Sheets

JIG AND METHOD FOR MANUFACTURING A CONTAINER

BACKGROUND OF THE INVENTION

1. Field of the Invention

The present invention relates to jigs and, more particularly, to a jig for holding a non-uniform container.

2. Description of Related Art

FIG. 15 shows a typical sealing apparatus 500 of the type used to attach a lid, or top, 502 to a container body 504. The container body 504 is shown as a can, such as one of the type used to contain carbonated beverages. It is noted that other types of containers, such as those used to contain food items, are sealed with the sealing apparatus 500 with only minor modifications.

The sealing apparatus 500 includes a jig 506 that supports a bottom portion of the container body 504. The jig 506 is movable relative to a base member 508 of the apparatus 500 via a piston 510. The apparatus 500 also includes a pressing structure 512 that engages an upper surface of the lid 502. The pressing structure 512 is vertically movable with respect to a support member 514 via a piston 516.

The sealing apparatus 500 is shown to include a pair of seaming rollers 518, 520 that are radially movable with respect to the container body 504 via respective support mechanisms 522, 524.

To attach the lid 502 to the container body 504, the lid 502 and body 504 have a vertically directed force applied thereto via the jig 506 and pressing structure 512. The seaming rollers 518, 520 are then brought into engagement with a lip portion 526 of the lid 502 and are rotated about a vertically extending longitudinal axis of the container body 504 and lid 502. As the seaming rollers 518, 520 are rotated, the lip 526 is caused to deflect and interlock with an upper portion 528 of the container body 504. The seaming rollers 518, 520 are rotated about the longitudinal axis of the container body 504 until an entire annular periphery of the lid 502 is interlocked and sealed with the upper portion 528.

The above-described process is often referred to as a "seaming process."Several factors, such as the specific material and/or thickness of the container body 504 and lid 502, the diameter of the lid 502 and container body 504, and the particular interlocking arrangement, or seam, formed between the lid 502 and container body 504, effect a relatively large resistance to movement of the seaming rollers 518, 520, i.e., effect a large resistance to deflection of the lip portion 526 and upper portion 528. Accordingly, the container body 504 and lid 502 must be held rotationally stationary as the seaming rollers 518, 520 rotate there about to ensure that the entire periphery of the lid 502 is sealed with the container body 504. In a case where one of the container body 504 and lid 502 are allowed to pivot, even slightly, the periphery of the lid 502 may not entirely be sealed with the container body 504, thus preventing a hermetic seal of the contents within the container body 504.

With the sealing apparatus 500 shown in FIG. 15, the container body 504 and lid 502 are held rotationally stationary by applying a significantly large vertically directed pressure on the container body 504 and lid 502 via the jig 506 and pressing structure 512, which prevents relative rotation due to the corresponding frictional engagement between the container body 504 and jig 506 and the lid 502 and pressing structure 512. However, in order to withstand the vertically directed holding pressure, a side wall 530 of the container body 504 must be made relatively rigid in the vertical direction. This is typically accomplished by utilizing a relatively durable material and/or constructing the side wall 530 with a relatively large thickness. Accordingly, costs of manufacturing containers utilizing a seaming process, such as one carried out by apparatus 500, is relatively large due to the structural necessities of the container.

SUMMARY OF THE INVENTION

It is one aspect of the present invention to provide a jig for a seaming apparatus that eliminates the need to place a container under a large vertical pressure to prevent rotation thereof during a seaming process.

It is another aspect of the present invention to provide a jig for a seaming apparatus that is capable of holding a container with a retaining element in a manner to prevent rotation of the container during a seaming process.

It is yet another aspect of the present invention to provide a jig that is capable of holding containers of different sizes and shapes in a manner to prevent rotation thereof during a seaming process.

According to one preferred embodiment of the present invention, a jig for holding a container having a retaining element is provided that includes a support portion configured to receive and vertically support the container thereon. The support portion has at least one retaining portion that is configured to non-rotationally lock with the retaining element of the container so as to substantially prevent relative rotation between the jig and container.

It is another aspect of the present invention to provide a sealing apparatus to seal a lid to a container without placing a substantial vertical pressure on the container.

It is another aspect of the present invention to provide a sealing apparatus that is capable of supporting a container with a retaining element in a manner to prevent rotation of the container during a seaming process.

It is yet another aspect of the present invention to provide a sealing apparatus that is capable of sealing containers of different shapes and sizes without placing a substantial vertical pressure of the container.

According to another preferred embodiment of the present invention, a sealing apparatus for sealing a container having a retaining element is provided that includes a fixture having a jig thereon and a pressing structure. At least one of the fixture and pressing structure is movable with respect to the other in the vertical direction. The jig includes a support portion configured to receive and vertically support the container thereon. The support portion has at least one retaining portion, which is configured to non-rotationally lock with the retaining element of the container so as to substantially prevent relative rotation between the jig and container.

It is yet another aspect of the present invention to provide a method of manufacturing a container without placing a substantial vertical pressure of the container.

According to another preferred embodiment of the present invention, a method of manufacturing a container is provided that includes forming a container body having a retaining element and providing a jig having a support portion configured to support the container body thereon and having a retaining portion configured to non-rotationally lock with the retaining element. The method also includes positioning the container body relative to the jig so as to effect the non-rotational lock between the retaining element and retaining portion and positioning a lid on an open end portion of the container body. Furthermore, the method includes attaching the lid to the container body by forming a seam between a periphery of the lid and the open end portion of the container body.

These and other aspects are described in or apparent from the following detailed description of preferred embodiments.

BRIEF DESCRIPTION OF THE DRAWINGS

Preferred embodiments are described with reference to the following Figures in which.

DETAILED DESCRIPTION OF PREFERRED EMBODIMENTS

Figure 1:
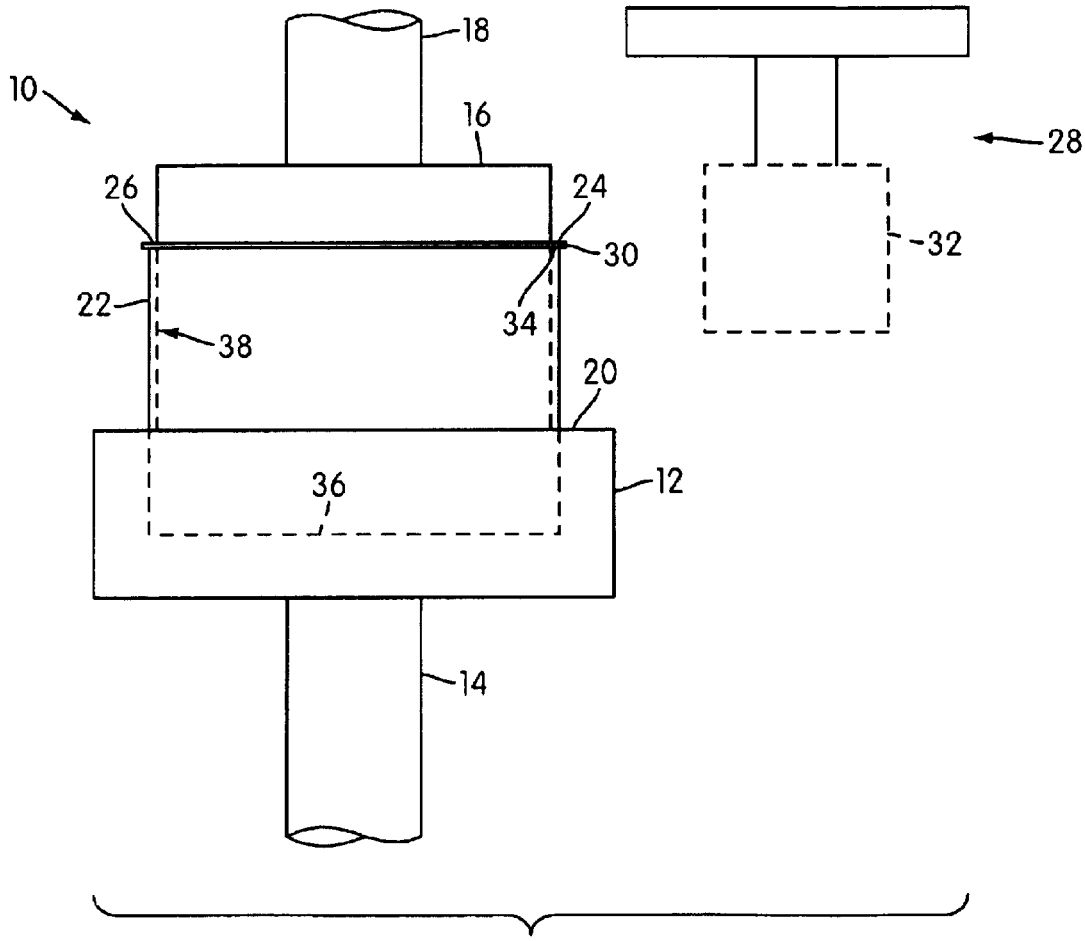
FIG. 1 is a schematic view of a seaming apparatus embodying the principles of the present invention.

FIG. 1 shows a sealing apparatus 10 that includes a jig 12 embodying principles of the present invention. The jig 12 may be vertically movable via a piston 14, which has the jig 12 mounted on an end thereof. The sealing apparatus 10 also includes a pressing member 16 that may be vertically movable via a piston 18. The jig 12 provides a retaining portion 20 that is defined by an upper surface thereof.

As shown in FIG. 1, a container 22 may be supported by the jig 12, while a lid 24 is pressed and held to an upper, open end 26 of the container 22 by the pressing member 16. While the lid 24 is held stationary relative to the container 22, a seaming mechanism 28 may be brought into engagement with an annular peripheral portion 30 of the lid 24. Subsequently, the seaming mechanism 28 may be rotated relative to a longitudinal axis of the container 22, such that a seaming roller 32 engages and deflects the peripheral portion 30 of the lid 24 about an entire periphery of the container 22 and lid 24. As the seaming roller 32 rotates around the periphery of the lid 24, the annular peripheral portion 30 of the lid 24 is rolled into a seam with an annular periphery 34 of the open end 26. In this manner, the interior of the container 22, defined by respective interiors of a bottom 36 of the container, a side wall 38 of the container, and the lid 24, may be hermetically sealed. It is preferable for the lid 24 and container 22 to be interlocked and sealed together about an entire periphery thereof in order to prevent leakage of the contents of the container and/or contamination of the contents from the atmosphere. It is also preferable to maintain stationary positions of the container 22 and lid 24 relative to one another, during the seaming process in order to ensure that the entire periphery of the lid 24 is sealed to the container 22. Rotational movement of the container 22 and/or lid 24 during the seaming process may prevent sealing of the entire periphery.

With previous apparatuses, the container 22 and lid 24 would be held stationary by applying a large magnitude vertically directed holding force to the container 22 and lid 24 via respective pistons 14, 18, thereby forming a strong frictional engagement between the container 22 and jig 12 and the lid 24 and pressing member 16. Accordingly, the side wall 38 of the container 22 was necessarily constructed relatively rigidly, such as with a large wall thickness and of a generally rigid material, to prevent damage, such as crushing, to the container 22.

To alleviate the necessity of forming the side walls 38 with a rigid construction, it is preferable for the container 22 to be formed with at least one non-uniform retaining element such that, in a case where the jig 12 is formed with cooperating retaining portion, the jig 12 may support the container 22 and prevent relative rotation therebetween, due to the engagement and non-rotational lock between the non-uniform retaining element and the retaining portion. In this manner, the vertically directed pressure applied to the container 22 may be significantly reduced, since a vertical force is not needed to form a strong frictional engagement between the container 22 and jig 12 in order to prevent relative rotation therebetween.

Figure 2A:
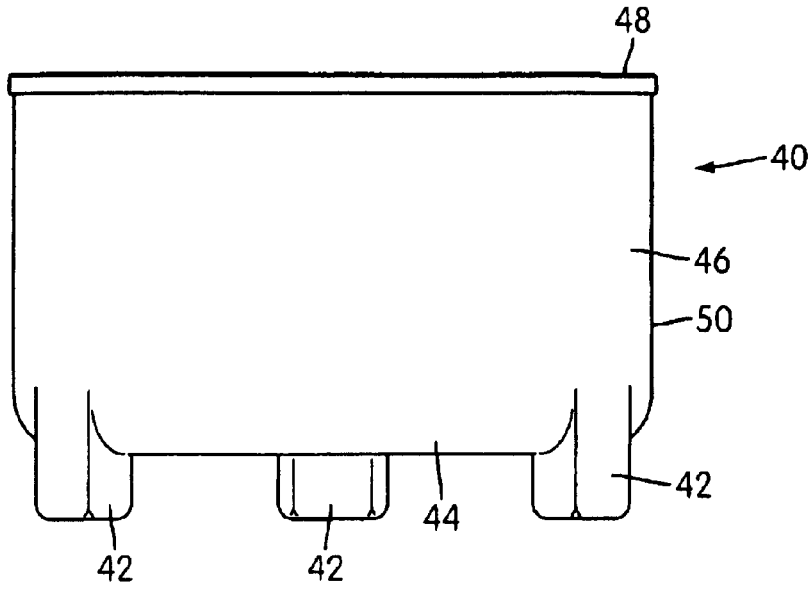
FIG. 2A is a side view of an example of a container with a non-uniform geometry.
Figure 2B:
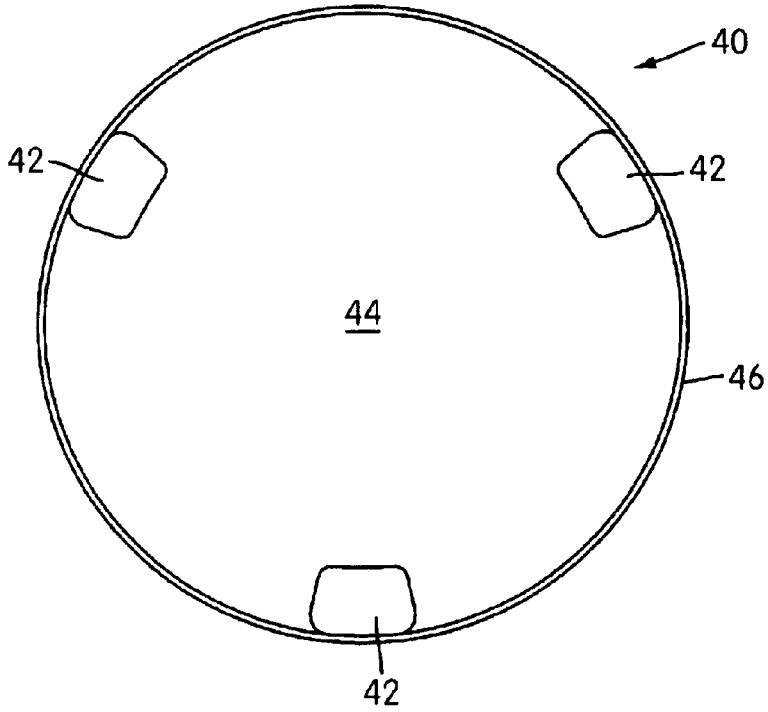
FIG. 2B is a bottom view of the container shown in FIG. 2A.

FIGS. 2A and 2B show a container 40 formed with non-uniform retaining elements 42. The container 40 may be manufactured of any material using an appropriate process. For example, the container 40 may be formed of stamped metal or a plastic blow-molded material. As shown, retaining elements 42 may be in the form of a series of "feet" protruding downwardly from a bottom portion 44 of the container 40. As particularly shown in FIG. 2B, the retaining elements 42 are generally equally annularly spaced from one another about an outer periphery of the container 40. As also shown, each of the retaining elements 42 is generally rectangularly shaped. The figures show the container 40 including three retaining elements 42, however, any number of retaining elements 42 may be used. Furthermore, the retaining elements 42 may have any specific shape and any position relative to the container 40.

It is contemplated that the container 40 may be formed of a generally circular body portion 46, which forms the bottom portion 44 on one end thereof and an open, or top, end 48 opposite the bottom portion 44. Additionally, the body portion 46 forms a generally circular side wall 50.

Figure 3:
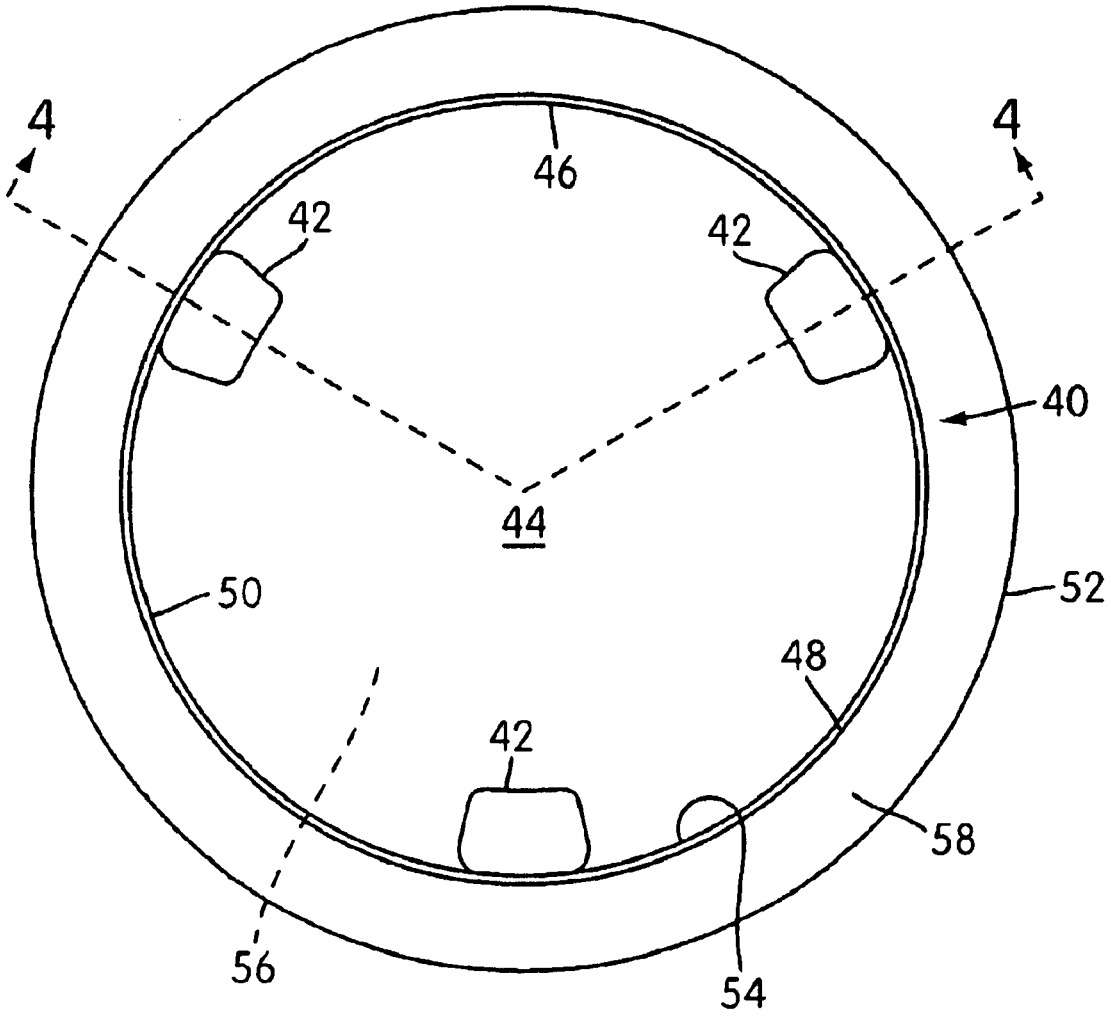
FIG. 3 is a top view of the container shown in FIG. 2A placed within a jig of the present invention.
Figure 4:
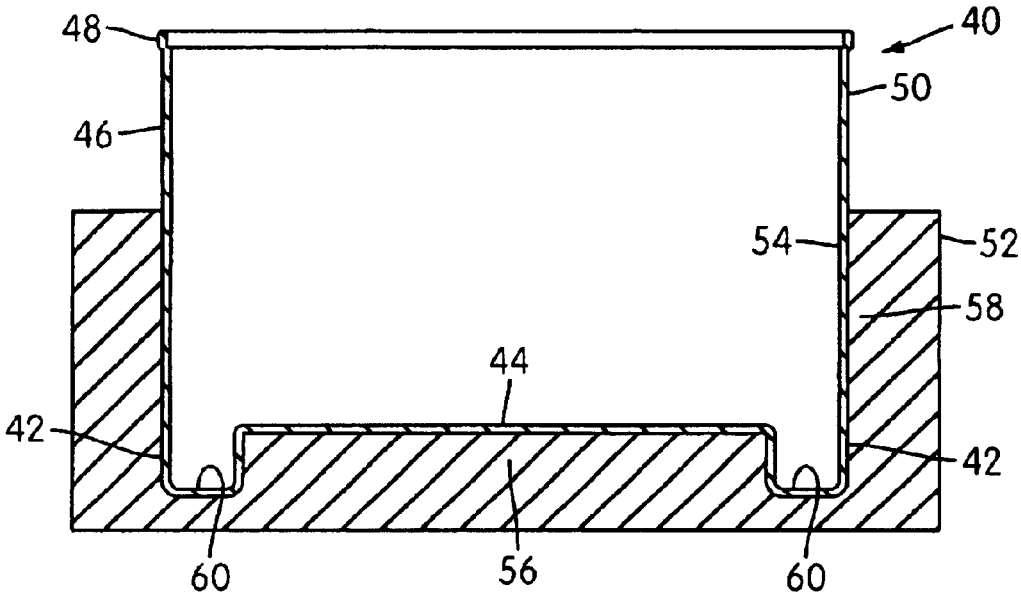
FIG. 4 is a cross-sectional view of the container and jig shown in FIG. 3 taken about line 4—4 in FIG. 3.

FIGS. 3 and 4 show the container 40 supported on a jig 52 embodying principles of the present invention. As shown in FIG. 4, the jig 52 may include an upwardly open recess 54 within which the bottom portion of 44 of the container 40 is disposed. A support portion of the jig 52 is configured to engage and vertically support the bottom portion 44 of the container 40. An upwardly extending side wall 58 may be provided shaped to receive and cooperate with an outer periphery of the side wall 50 of the container 40. Additionally, the jig 52 may include a plurality of retaining portions 60 that are configured and positioned to cooperate with respective retaining elements 42 of the container 40. As shown, the retaining portions 60 may be in the form of recesses shaped to receive respective retaining elements 42 of the container 40, thereby non-rotationally retaining the container 40.

It may be preferable for the retaining portions 60 to have a shape complimentary to the retaining elements 42 that are to be disposed therein. However, the retaining portions 60 may be of any shape that allows the retaining elements 42 to be disposed therein so as to prevent the container 40 from rotating relative to the jig 52. The bottom portion 44 of the container 40 may have a concave or convex shape (or, in fact, any other desired shape) and it may be preferable for the support portion 46 to be shaped so as to compliment and thereby vertically support the bottom portion 44.

Figure 5:
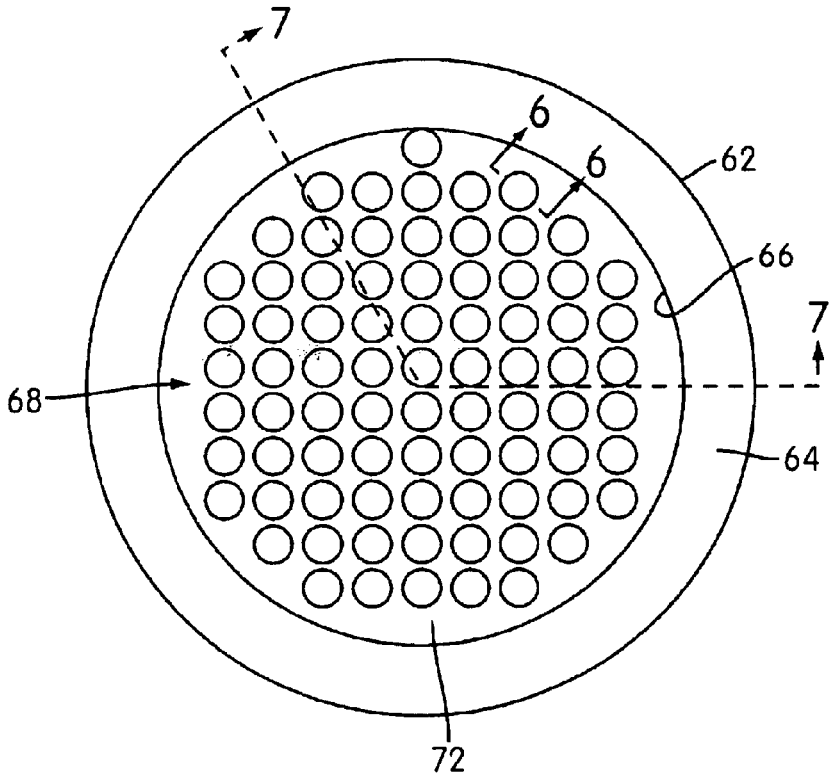
FIG. 5 is a top view of a jig according to an alternate embodiment of the present invention.
Figure 6:
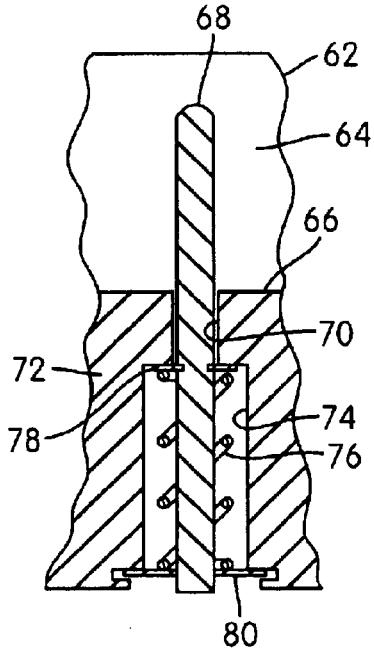
FIG. 6 is a cross-sectional view of a retaining pin and jig shown in FIG. 5 taken about line 6—6 in FIG. 5.
Figure 7:
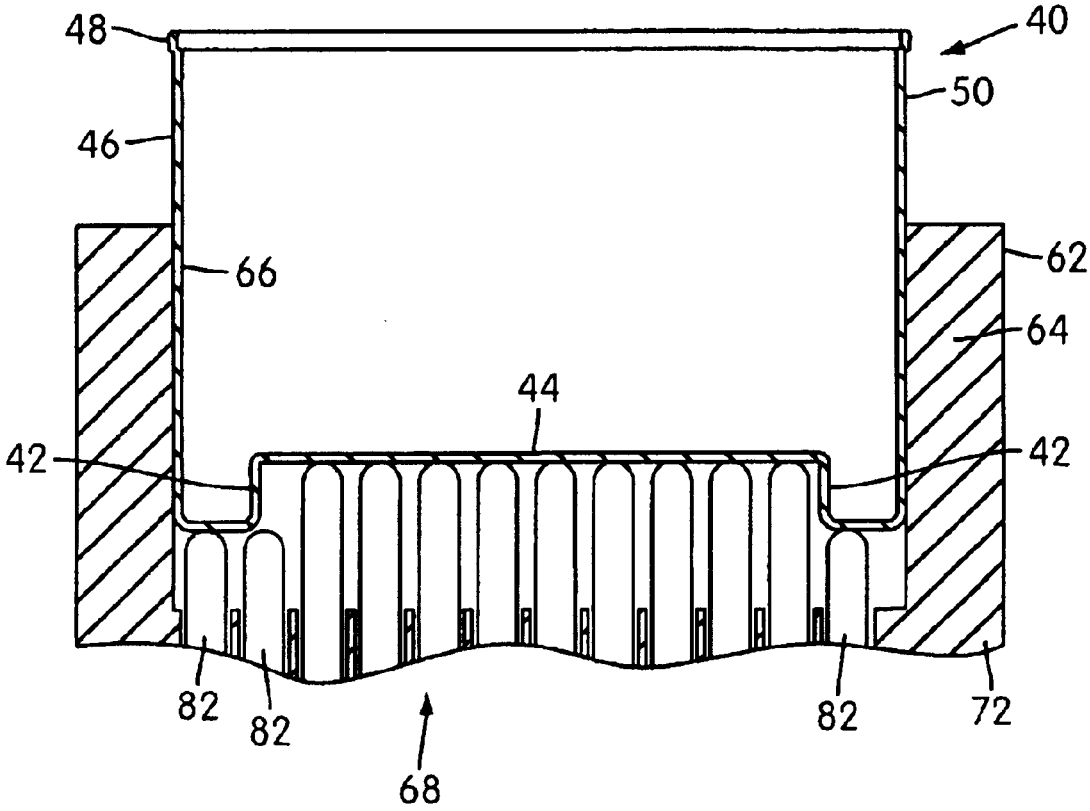
FIG. 7 is a cross-sectional view of the container and jig shown in FIG. 5 taken about line 7—7 in FIG. 5.

FIGS. 5–7 show another embodiment of a jig embodying the principles of the present invention, indicated at 62. As shown, the jig 62 may include an annular upwardly extending side wall 64 that provides an upwardly facing recess 66. A plurality of upwardly extending pin elements 68 are disposed within the recess 66.

As shown in FIG. 6, each of the pin elements 68 extends through a vertically extending opening 70 within an intermediate portion 72 of the jig 62. The intermediate portion 72 includes a downwardly facing bore 74 within which a biasing element 76 is disposed. As shown, the biasing element 76 may be a helical coil spring that biases the pin element 68 in an upward direction between a clip structure 78 and ring structure 80. The specific construction and arrangement of the pin element 68 described above is merely exemplary and may, of course, be constructed in any other suitable fashion.

As discussed above, each of the pin elements 68 is upwardly biased by a biasing element 76. Accordingly, as a container is moved into the recess 66, the pin elements 68 are moved downwardly by a bottom of the container and conform to the bottom of the container. In this manner, any container with a non-uniform shape at its bottom portion may be non-rotationally held relative to the jig 62 by the pin elements 68. It is noted that due to the independent movement of each of the pin elements 68, containers of different shapes and sizes may be utilized with the jig 62.

FIG. 7 shows the jig 62 in use with the container 40 previously described above with respect to jig 52. As shown, the retaining elements 42 of the container 40 overlie certain pin elements, which are indicated at 82. The pin elements 82 are pushed below a height of the remaining pin elements 68 as the container 40 is pushed downwardly within the recess 66. Pin elements 68 adjacent the pin elements 82 engage sides of the retaining elements 42 and thereby prevent the container 40 from rotating relative to the jig 62. This embodiment of the jig of the present invention is able to accept containers of different sizes and shapes, as well as those with retaining portions of different configurations.

The specific configurations and constructions of the embodiments of the jig of the present invention discussed above are merely exemplary and are not meant to be limiting. It is contemplated that any configuration of the jig of the present invention that is non-rotationally lockable with a container to be sealed is possible, as long as the jig is capable of substantially preventing relative rotational movement of the container. Other embodiments discussed below are given for further example and are not meant to be limiting to the scope of the present invention.

Figure 8:
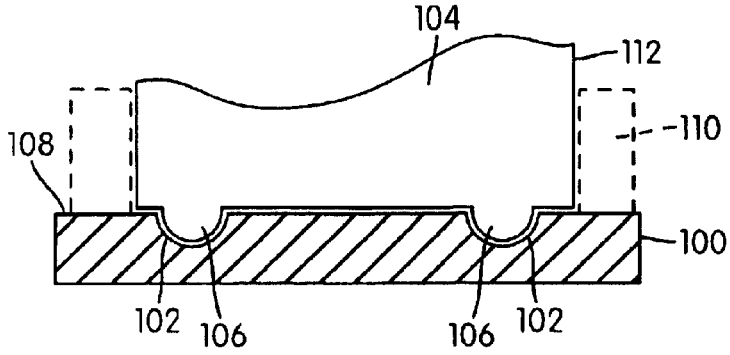
FIGS. 8–14 are schematic views of different embodiments of a jig.

FIG. 8 shows another embodiment of the present invention as jig 100, which is formed with a plurality of recessed retaining portions 102. As shown, the recessed retaining portions 102 may be in the form of recesses within the jig 100. The recessed retaining portions 102 are shown having a spherical geometry, but, of course, may have any other suitable geometry. As further shown, a container 104 having a plurality of retaining elements 106 may be supported by the jig 100. The retaining elements 106 are shown as dome-shaped protrusions extending downwardly from a bottom portion of the container 104. It is also contemplated that the retaining elements 106 may have any other shape complimentary to the recessed retaining portions 102.

As shown, the retaining elements 106 of the container 104 are received within the recessed retaining portions 102. The cooperation of the retaining elements 106 and retaining portions 102 prevent relative rotation between the jig 100 and container 104 during a seaming process.

As further shown, the jig 100 may be in the form of a substantially flat plate, with the recessed retaining portions 102 extending below an upper surface 108 of the jig 100. Alternatively, the jig 100 may be provided with a generally upwardly extending side wall 110 to provide support to a side wall 112 of the container 104.

Figure 9:
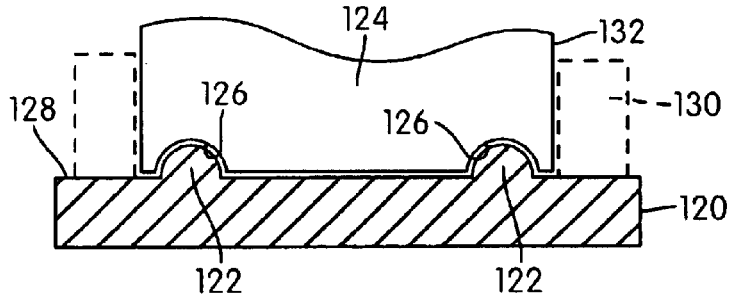

FIG. 9 shows another embodiment of the present invention as jig 120, which is formed with a plurality of protruding retaining portions 122. As shown, the protruding retaining portions 122 may be in the form of dome-shaped protrusions extending generally upwardly from the jig 120. The protruding retaining portions 122 are shown having a spherical geometry, but, of course, may have any other suitable geometry. As further shown, a container 124 having a plurality of retaining elements 126 may be supported by the jig 120. The retaining elements 126 are shown as generally spherical recesses extending upwardly into a bottom portion of the container 124. It is also contemplated that the retaining elements 126 may have any other shape complimentary to the protruding retaining portions 122.

As shown, the protruding retaining portions 122 are received within the retaining elements 126 of the container 124. The cooperation of the retaining elements 126 and retaining portions 122 prevent relative rotation between the jig 120 and container 124 during a seaming process.

As further shown, the jig 120 may be in the form of a substantially flat plate, with the protruding retaining portions 122 extending above an upper surface 128 of the jig 120. Alternatively, the jig 120 may be provided with a generally upwardly extending side wall 130 to provide support to a side wall 132 of the container 124.

Figure 10:
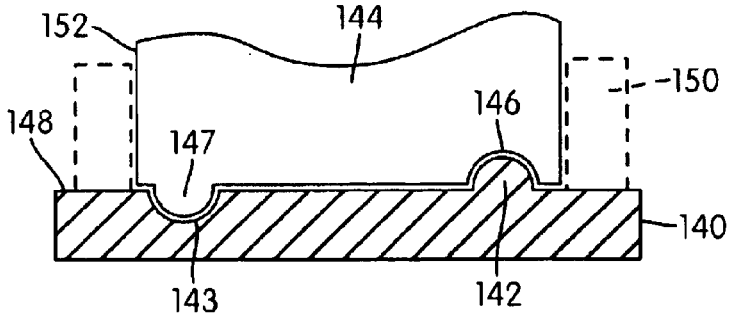

FIG. 10 shows another embodiment of the present invention as jig 140, which is formed with pluralities of protruding retaining portions 142 and recessed retaining portions 143. As shown, the protruding retaining portions 142 are in the form of dome-shaped protrusions extending generally upwardly from the jig 140, while the recessed retaining portions 143 are in the form of generally spherical recesses formed within the jig 140. Of course, any other geometry of the retaining portions 142, 143 is possible. As further shown, a container 144 having a plurality of recessed retaining elements 146 and a plurality of protruding retaining elements 147 may be supported by the jig 140. The recessed retaining elements 146 are shown as generally spherical recesses extending upwardly into a bottom portion of the container 144, while the protruding retaining elements 147 are in the form of generally dome-shaped protrusions extending downwardly from the bottom portion of the container 144. It is also contemplated that the retaining elements 146, 147 may have any other shape complimentary to the respective retaining portions 142, 143. It may be preferable for the plurality or protruding retaining elements 147 to be at least somewhat equally spaced about the bottom of the container to provide a degree of stability to the container 144 when supported on a flat surface. For example, the container 144 may include three or more protruding retaining elements 147 that are equally annularly spaced about the bottom of the container 144 and may still include any number of recessed retaining elements 146.

As shown, the protruding retaining portions 142 are received within the recessed retaining elements 146, while the recessed retaining portions 143 receive the protruding retaining elements 147. The cooperation of the retaining elements 146, 147 and respective retaining portions 142, 143 prevent relative rotation between the jig 140 and container 144 during a seaming process.

As further shown, the jig 140 may be in the form of a substantially flat plate, with the protruding retaining portions 142 extending above an upper surface 148 of the jig 140, while the recessed retaining portions 143 extend below the surface 148. Alternatively, the jig 140 may be provided with a generally upwardly extending side wall 150 to provide support to a side wall 152 of the container 144.

Figure 11:
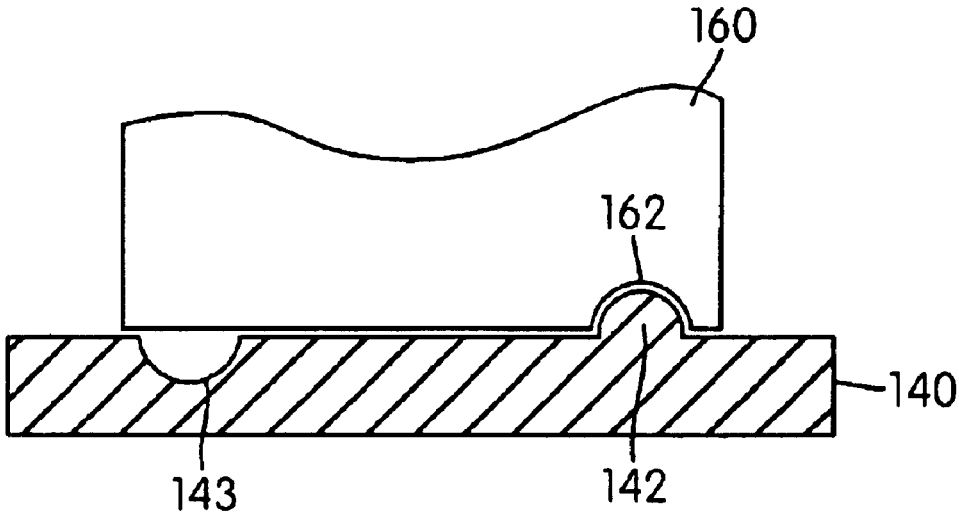

FIG. 11 shows the jig 140 supporting a container 160 with recessed retaining elements 162. Specifically, the recessed retaining elements 162 are in the form of generally spherical recesses within a bottom portion of the container 160. The container 160 may not include protruding retaining elements to be received within the recessed retaining portions 143. However, the jig 140 may still prevent relative rotational movement between the jig 140 and container 160 due to the cooperation of the protruding retaining portions 142 and respective recessed retaining elements 162. In this manner, the jig 140 may be used with containers having either or both of protruding and recessed type retaining elements.

The specific geometries of the retaining elements and retaining portions discussed above are not meant to be limiting, rather, are meant to merely provide viable examples. Any other suitable geometries are, of course, possible.

Figure 12:
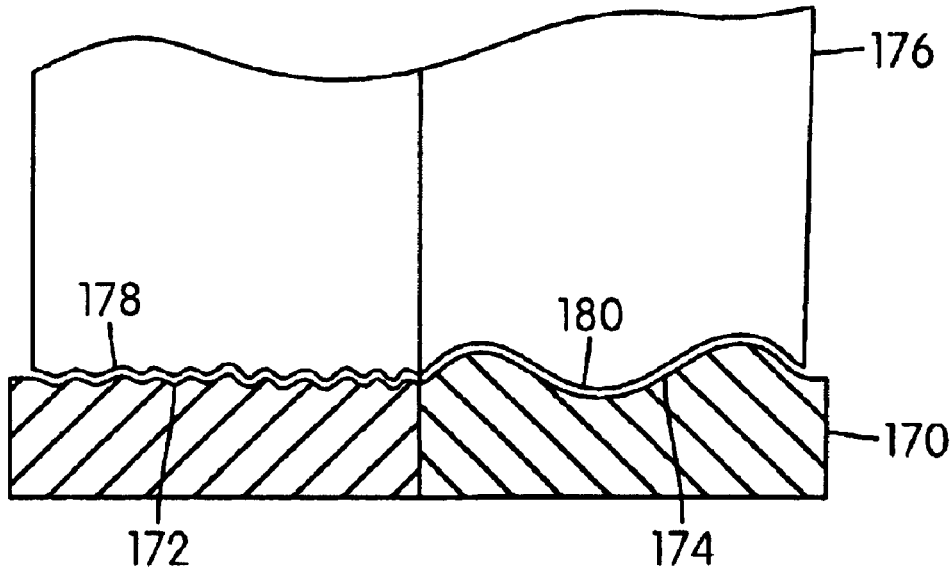

FIG. 12 illustrates two other embodiments of the present invention as jig 170 having a retaining portion provided by either a textured surface 172 or a contoured surface 174. As shown, the textured or contoured surfaces 172, 174 may be used to support and rotationally retain a container 176 having a respective retaining element provided by cooperating textured surface 178 and contoured surface 180, respectively. The cooperation between engaged, abutting textured surfaces 172, 178 or contoured surfaces 174, 180 prevent relative rotational movement between the container 176 and jig 170.

Figure 13:
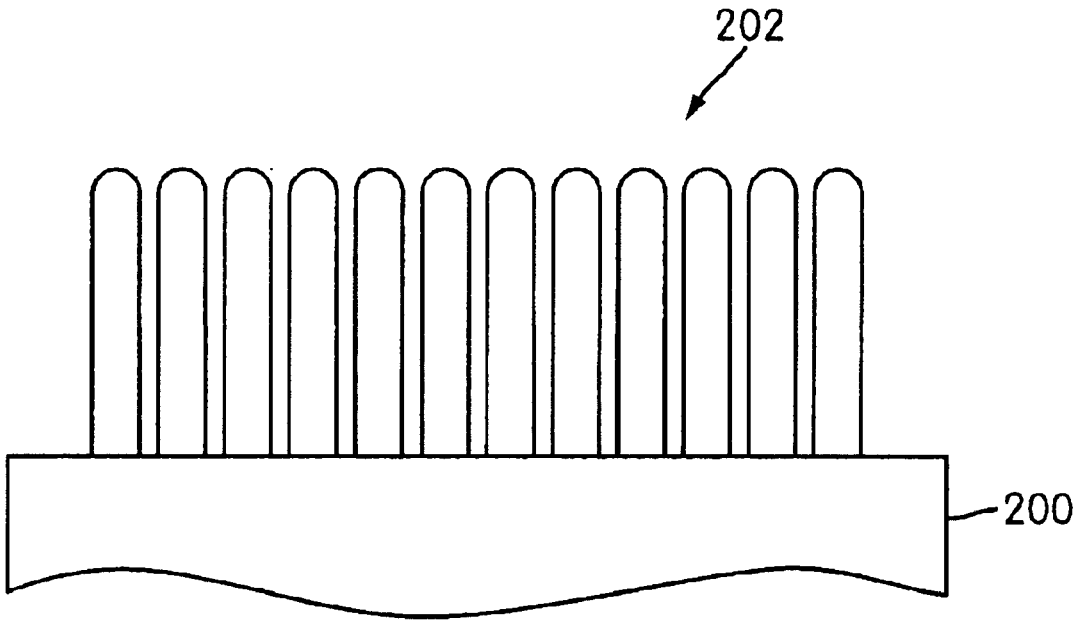

FIG. 13 illustrates yet another embodiment of the present invention as jig 200, which includes a plurality of pin elements 202, similar to jig 62 described previously and shown in FIGS. 5–7. In contrast to jig 62, however, jig 200 does not include a side wall, as shown at 62 in FIG. 7. By eliminating the side wall, containers with outer diameters of considerable size may still be supported and non-rotationally retained by the jig 200 (i.e., pin elements 202) without interference. Additionally, the jig 200 may also be used to support containers with untypical peripheral shapes.

Figure 14:
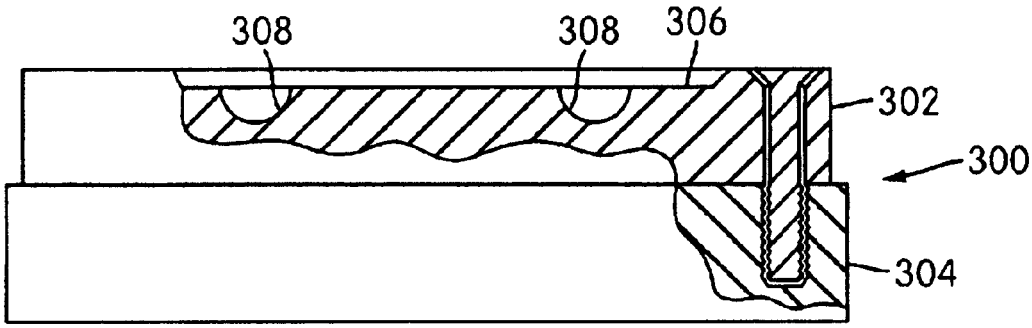
Figure 15:
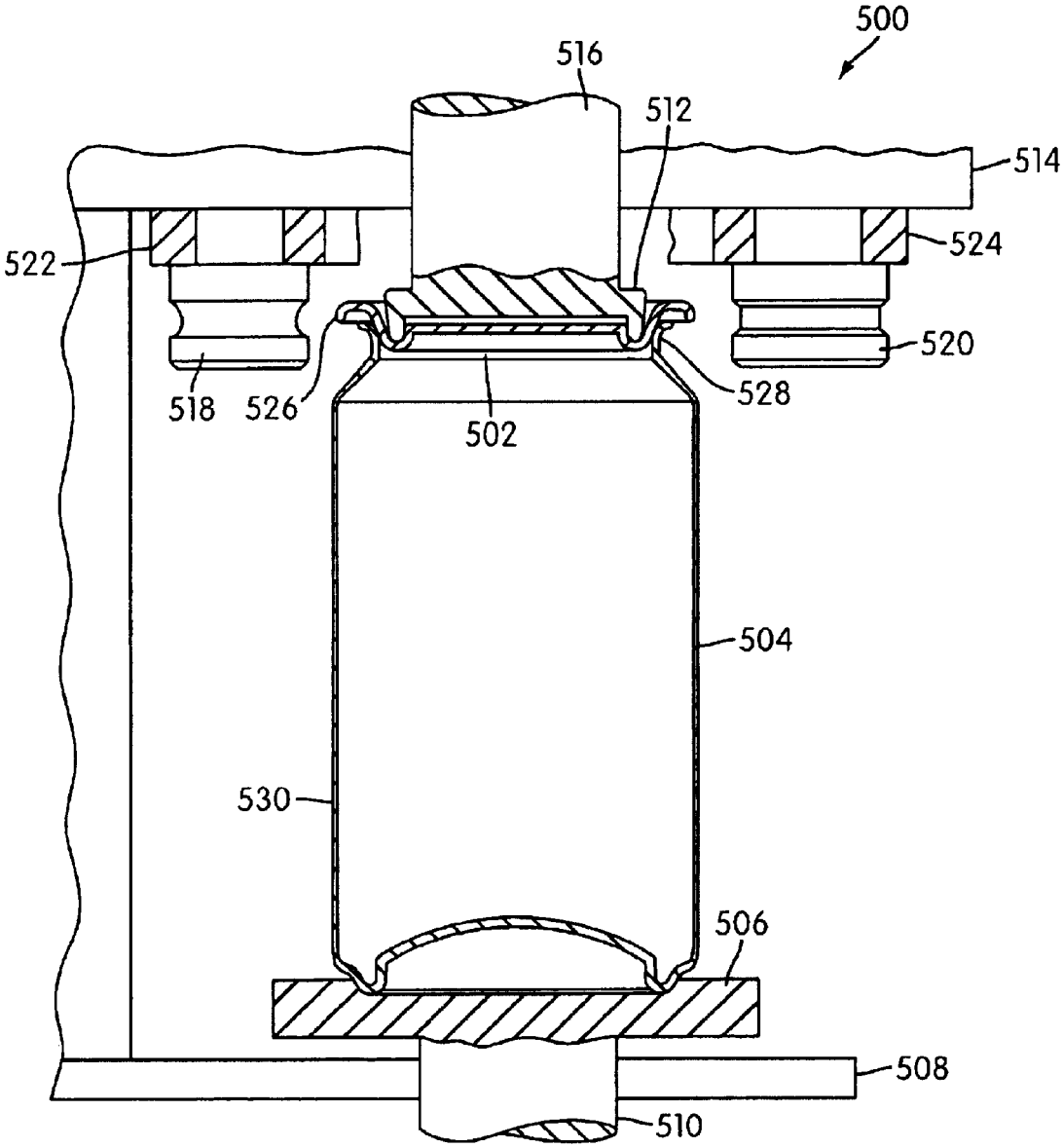
FIG. 15 is a side view of a prior art sealing apparatus.

FIG. 14 illustrates an additional embodiment of the present invention as jig 300, which includes a detachable and interchangeable retaining plate 302. The jig 300 includes a base member 304, to which the retaining plate 302 is detachably mounted, such as with mechanical fasteners. As shown, the retaining plate 302 provides a support portion 306 and retaining portions 308. The retaining portions 308 are shown as generally spherical recesses, however, it is noted that the retaining portions 308 may be in any form, such as any of the above described retaining portions (e.g., recesses, protrusions, pin elements, textured surfaces, contoured surfaces, etc.). With the arrangement shown in FIG. 14, the jig 300 may be altered by interchanging retaining plates 302 with specific geometries (e.g., retaining portions) so as to be used with containers of different configurations, such as different shaped retaining elements.

It is noted that the container is not limited to the specific constructions and configuration thereof described herein. The container may vary, for example, in size (e.g., height or diameter), geometry (e.g., circular or non-circular, etc.), or configuration (tapered or fluted, etc.). It is also contemplated that the container may be formed of any suitable material, such as plastic, metal, or glass. One possible embodiment of a container is disclosed in co-pending U.S. Design Application No. 29/148,738, the content of which is hereby incorporated in its entirety into the present application by reference, as having a hammered metal appearance, such as may be possible by forming the container from a stippled base metal material (e.g., steel).

Additionally, the retaining elements of a container may be altered. For example, the container 40 is shown in FIG. 2A having three retaining elements 42 in the form of three "feet." It is noted that, alternatively, a container may have any number of feet, such as 4, 5, or 6, of any configuration, such as circular, rectangular, or, for example, in the form of downwardly extending dimples or pegs. It is also noted that retaining elements may be in the form of recesses formed within a container, which may be of any number and have any size, shape, or configuration. Furthermore, a container may include a variety of retaining elements having different configurations, such as a container having pluralities of both "feet" and recesses. Other configurations of a container are, of course, contemplated.

It will be appreciated that numerous modifications to and departures from the preferred embodiments described above will occur to those having skill in the art.

What is claimed is:

1. A jig for holding a container having a non-planar bottom that provides at least one retaining element, the retaining element providing a first cooperating interlocking surface, the jig comprising;

a support portion configured to receive and vertically support the container thereon, the support portion having at least one retaining portion providing a second cooperating interlocking surface wherein the second cooperating interlocking surface has a share that is complimentary to a shape of the first cooperating interlocking surface such that the second cooperating interlocking surface, of the retaining portion is non-rotationally interlockable with the first cooperating interlocking surface of the retaining element of the container in a cooperating relationship so as to substantially prevent relative rotation between the jig and container.

2. A jig as in claim 1, wherein the jig is in the form of a generally flat plate.

3. A jig as in claim 1, further comprising a generally annular side wall extending upwardly from the support portion.

4. A jig as in claim 1, wherein the support portion includes a support surface configured to abut a bottom portion of the container, thereby vertically supporting the container.

5. A jig as in claim 1, wherein the at least one retaining portion includes a generally downwardly extending recess formed within the support portion.

6. A jig as in claim 5, wherein the at least one retaining portion includes a plurality of generally downwardly extending recesses formed within the support portion.

7. A jig as in claim 1, wherein the at least one retaining portion includes a generally upwardly extending protrusion formed on the support portion.

8. A jig as in claim 7, wherein the at least one retaining portion includes a plurality of generally upwardly extending protrusions formed on the support portion.

9. A jig as in claim 1, wherein the at least one retaining portion includes a textured surface formed on the support portion.

10. A jig as in claim 9, wherein the textured surface is formed on the support surface.

11. A container made using a jig according to claim 1.

12. A sealing apparatus for sealing a container having a non-planar bottom that provides at least one retaining element, the retaining element providing a first cooperating interlocking surface, the apparatus comprising:

a fixture having a jig thereon;

a pressing structure, wherein at least one of the fixture and pressing structure are movable with respect to the other in the vertical direction, and wherein the jig includes a support portion configured to receive and vertically support the container thereon, the support portion having at least one retaining portion providing a second cooperating interlocking surface, wherein the second cooperating interlocking surface has a shape that is complimentary to a shape of the first cooperating interlocking surface such that the second cooperating interlocking surface of the retaining portion is non-rotationally interlockable with the first cooperating interlocking surface of the retaining element of the container in a cooperating relationship so as to substantially prevent relative rotation between the jig and container.

13. A sealing apparatus as in claim 12, further comprising a piston connected to the at least one of the fixture and pressing structure so as to provide the relative vertical movement thereof.

14. A sealing apparatus as in claim 12, wherein the jig is in the form of a generally flat plate.

15. A sealing apparatus as in claim 12, wherein the jig includes a generally annular side wall extending upwardly from the support portion of the jig.

16. A sealing apparatus as in claim 12, wherein the support portion of the jig includes a support surface configured to abut a bottom portion of the container, thereby vertically supporting the container.

17. A sealing apparatus as in claim 12, wherein the at least one retaining portion includes a generally downwardly extending recess formed within the support portion of the jig.

18. A sealing apparatus as in claim 17, wherein the at least one retaining portion includes a plurality of generally downwardly extending recesses formed within the support portion.

19. A sealing apparatus as in claim 12, wherein the at least one retaining portion includes a generally upwardly extending protrusion formed on the support portion of the jig.

20. A sealing apparatus as in claim 19, wherein the at least one retaining portion includes a plurality of generally upwardly extending protrusions formed on the support portion of the jig.

21. A sealing apparatus as in claim 12, wherein the at least one retaining portion includes a textured surface formed on the support portion of the jig.

22. A sealing apparatus as in claim 21, wherein the textured surface is formed on the support surface.

23. A container made using a sealing apparatus according to claim 12.

24. A method of manufacturing a container comprising:

forming a container body having a non-planar bottom that provides at least one retaining element, the retaining element providing a first cooperating interlocking surface;

providing a jig having a support portion configured to support the container body thereon and having a retaining portion providing a second cooperating interlocking surface, the second cooperating interlocking surface having a shape that is complimentary to a shape of the first cooperating interlocking surface such that the second cooperating interlocking surface of the retaining portion is non-rotationally interlockable with the first cooperating interlocking surface of the retaining element of the container in a cooperating relationship;

positioning the container body relative to the jig so as to non-rotationally interlock the first cooperating interlocking surface of the retaining element and the second cooperating interlocking surface of the retaining portion so as to substantially prevent relative rotation between the container and the jig;

positioning a lid on an open end portion of the container body; and attaching the lid to the container body by forming a seam between a periphery of the lid and the open end portion of the container body.

25. A container made using a method according to claim 24.

* * * * *